US007997010B2

(12) United States Patent
Rosenbaum

(10) Patent No.: US 7,997,010 B2
(45) Date of Patent: Aug. 16, 2011

(54) SHOE SUSPENSION SYSTEM

(75) Inventor: Ori Rosenbaum, Laguna Beach, CA (US)

(73) Assignee: Auri Footwear, Inc., Laguna Beach, CA (US)

( * ) Notice: Subject to any disclaimer, the term of this patent is extended or adjusted under 35 U.S.C. 154(b) by 838 days.

(21) Appl. No.: 12/034,467

(22) Filed: Feb. 20, 2008

(65) Prior Publication Data

US 2009/0205224 A1 Aug. 20, 2009

(51) Int. Cl.
*A43B 13/00* (2006.01)

(52) U.S. Cl. ..... 36/25 R; 36/30 R; 36/76 R; 36/114

(58) Field of Classification Search ..... 036/25 R, 036/88, 30 R, 31, 76 R, 107, 114
See application file for complete search history.

(56) References Cited

U.S. PATENT DOCUMENTS 4,481,727 A * 11/1984 Stubblefield ..... 36/83
4,501,077 A * 2/1985 Young ..... 36/32 R
4,704,808 A 11/1987 Bianchini et al.
4,783,910 A 11/1988 Boys et al.
4,794,707 A 1/1989 Franklin et al.
5,070,629 A 12/1991 Graham et al.
5,077,915 A 1/1992 Gross
5,561,920 A 10/1996 Graham et al.
5,860,226 A 1/1999 Graham et al.
6,119,373 A * 9/2000 Gebhard et al. ..... 36/114
6,145,220 A 11/2000 Johnson et al.
6,199,303 B1 * 3/2001 Luthi et al. ..... 36/31
6,321,469 B1 11/2001 Cretinon
6,438,873 B1 * 8/2002 Gebhard et al. ..... 36/114
6,446,359 B2 9/2002 Tomat
6,477,791 B2 * 11/2002 Luthi et al. ..... 36/31
6,497,058 B2 * 12/2002 Dietrich et al. ..... 36/69
6,508,017 B1 1/2003 DeBarro et al.
7,082,702 B2 * 8/2006 Cretinon ..... 36/88
7,174,659 B2 * 2/2007 Delgorgue ..... 36/59 R
7,299,567 B2 * 11/2007 Berend et al. ..... 36/88
7,380,353 B2 6/2008 Feller et al.
7,401,424 B2 * 7/2008 Kerns et al. ..... 36/131
7,418,791 B2 * 9/2008 Cole, III ..... 36/30 R
7,421,805 B2 * 9/2008 Geer ..... 36/25 R
7,549,236 B2 * 6/2009 Dillon et al. ..... 36/30 R
7,647,709 B2 * 1/2010 Reilly et al. ..... 36/30 R
2003/0029059 A1 * 2/2003 Favreau et al. ..... 36/59 C
2004/0098881 A1 * 5/2004 Flavio et al. ..... 36/25 R
2005/0034328 A1 * 2/2005 Geer ..... 36/30 R
2005/0178024 A1 * 8/2005 Hauglin ..... 36/25 R
2007/0124960 A1 6/2007 Friedman

* cited by examiner

*Primary Examiner* — Marie Patterson
(74) *Attorney, Agent, or Firm* — Snell & Wilmer L.L.P.

(57) ABSTRACT

The present invention relates to a shoe suspension system. In one embodiment, the present invention is a sole of a shoe including a first spine with a first side and a second side, a first suspension portion connected to the first side of the first spine, and a second suspension portion connected to the second side of the first spine.

19 Claims, 5 Drawing Sheets

SHOE SUSPENSION SYSTEM

BACKGROUND

1. Field

The present invention relates to a shoe suspension system.

2. Related Art

Many shoes are designed and developed for aesthetic purposes. However, in designing and developing shoes for aesthetic purposes, designers have often neglected two aspects of the shoe, comfort and functionality. Thus, while a pair of shoes may look stylish, they can often be cumbersome and painful to walk, jog, or run in. Therefore, there is a need for a shoe that is stylish, comfortable and functional allowing a user to move with ease.

SUMMARY

In one embodiment, the present invention is a sole of a shoe including a first spine with a first side and a second side, a first suspension portion connected to the first side of the first spine, and a second suspension portion connected to the second side of the first spine.

BRIEF DESCRIPTION OF THE DRAWINGS

The features, objects, and advantages of the present invention will become more apparent from the detailed description set forth below when taken in conjunction with the drawings, wherein.

DETAILED DESCRIPTION

Shoes that implement the embodiments of the various features of the present invention will now be described with reference to the drawings. The drawings and the associated descriptions are provided to illustrate embodiments of the present invention and not to limit the scope of the present invention. Reference in the specification to "one embodiment" or "an embodiment" is intended to indicate that a particular feature, structure, or characteristic described in connection with the embodiment is included in at least an embodiment of the present invention. The appearances of the phrase "in one embodiment" or "an embodiment" in various places in the specification are not necessarily all referring to the same embodiment. Throughout the drawings, reference numbers are re-used to indicate correspondence between referenced elements. In addition, the first digit of each reference number indicates the figure in which the element first appears.

Figure 1:
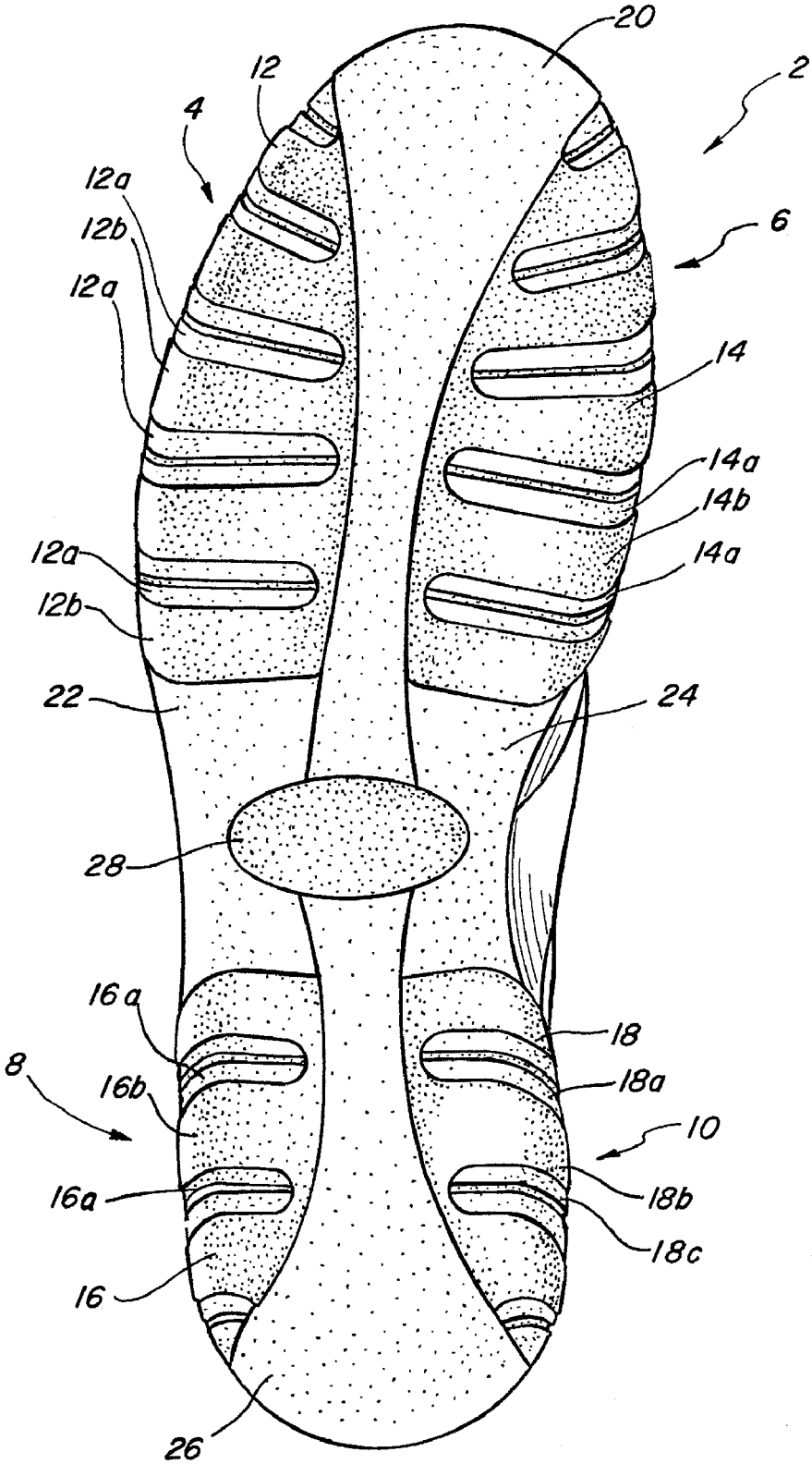
FIG. 1 is a bottom view of a sole of a shoe according to an embodiment of the present invention.

As shown in FIG. 1, a sole 2 of a shoe 30 (shown in FIG. 2) includes a first spine 20, a first suspension portion 4, a second suspension portion 6, a third suspension portion 8, a fourth suspension portion 10, a first bridge 22, a second bridge 24, a second spine 26, and a middle portion 28.

First suspension portion 4 is connected to first spine 20 on a first side of first spine 20, while second suspension portion 6 is connected to first spine 20 on a second side of first spine 20. First suspension portion 4 is also connected to first bridge 22, while second suspension portion 6 is also connected to second bridge 24.

First bridge 22 is connected to first spine 20 on the first side of first spine 20 and to second spine 26 on a first side of second spine 26, while second bridge 24 is connected to first spine 20 on the second side of first spine 20 and to second spine 26 on a second side of second spine 26.

Third suspension portion 8 is connected to second spine 26 on the first side of second spine 26, while fourth suspension portion 10 is connected to second spine 26 on the second side of spine 26. Third suspension portion 8 is also connected to first bridge 22, while fourth suspension portion 10 is also connected to second bridge 24.

Sole 2 also includes an optional middle portion 28 connected to first spine 20, second spine 26, first bridge 22, and second bridge 24. Middle portion 28 may be formed in the shape of a circle, oval or ellipse. Middle portion 28 may have a different height from first spine 20, second spine 26, first bridge 22, and/or second bridge 24. For example, middle portion 28 may be at the same level, recessed from or protruding from first spine 20, second spine 26, first bridge 22, and/or second bridge 24. First spine 20 and second spine 26 may be each be formed in the shape of an hourglass. In addition, a top portion of first spine 20 may be wider than a bottom portion of first spine 20. Conversely, a bottom portion of second spine 26 may be wider than a top portion of second spine 26.

First suspension portion 4, second suspension portion 6, third suspension portion 8, and fourth suspension portion 10 each comprise a plurality of wings 12, 14, 16, and 18, respectively. Plurality of wings 12*b*, 14*b*, 16*b*, and 18*b* contact the ground surface and each portion 4, 6, 8, and 10 provides an independent suspension for shoe 2. Plurality of wings 12*a*, 14*a*, 16*a*, and 18*a* are at the same level or depressed or recessed from plurality of wings 12*b*, 14*b*, 16*b*, and 18*b* and may not contact the ground surface. In one embodiment, the plurality of wings 12, 14, 16, and 18 may alternate in and out to provide better stability and suspension. Each of the plurality of wings 12*a*, 14*a*, 16*a*, and 18*a* has a center slit that allows plurality of wings 12*a*, 14*a*, 16*a*, and 18*a* to bend allowing shoe 2 to have better movement and comfort for walking, jogging, or running.

Each of the plurality of wings 12, 14, 16, and 18 can optionally comprise a plurality of multi-colored portions. For example, one of the wings 12 can comprise a portion with a first color 12*a* and a portion with a second color 12*b*. Each of the plurality of wings 12 can also comprise multiple portions with a first color 12*a*. Although only one portion with a second color 12*b* is depicted for each of the plurality of wings 12, it is contemplated that there can be multiple portions with a second color 12*b*. Furthermore, each of the plurality of wings 12 can be comprised entirely of one color such as first color 12*a* or second color 12*b*, or any other color.

Plurality of wings 14, 16, and 18 can have a similar construction as plurality of wings 12. However, it is not necessary that all of the plurality of wings 12, 14, 16, and 18 have the same construction. Thus, plurality of wings 12 and 14 can have one construction while plurality of wings 16 and 18 can have another construction. For example, plurality of wings 12 and 14 can have wings which have a first color 12*a* and a second color 12*b* while plurality of wings 16 and 18 can have wings with only a second color 12*b*.

Furthermore, the number of wings in plurality of wings 12, 14, 16, and 18 does not have to be uniform. For example, plurality of wings 12 and 14 can have 5 wings each, while plurality of wings 16 and 18 can have 3 wings each. In one embodiment, plurality of wings 12, 14, 16, and 18 can each have a different number of wings.

In operation, when a force is placed on sole 2 such as when a user is walking, sole 2 can bend to accommodate the force. First suspension portion 4, second suspension portion 6, third suspension portion 8, fourth suspension portion 10, first spine 20, first bridge 22, second bridge 24, second spine 26, and middle portion 28 bend and react differently from each other with each suspension portion, spine, or bridge bending and reacting based on the amount and portion of the force it receives from the force placed on sole 2. Thus, for example, if the force is placed across first suspension portion 4, first spine 20 and second suspension portion 6, with a greater portion of the forced directed at first suspension portion 4, a lesser portion of the force directed at first spine 20, and the least amount directed at second suspension portion 6, first suspension portion 4 can bend more than first spine 20 and second suspension portion 6. Likewise, first spine 20 can bend more than second suspension portion 6. In addition, since the force is localized to first suspension portion 4, first spine 20, and second suspension portion 6, the remaining portions of sole 2 such as first bridge 22, second bridge 24, second spine 26, third suspension portion 8, fourth suspension portion 10, and middle portion 28 can remain unbent allowing sole 2 to better mold to the user's foot.

Furthermore, within first suspension portion 4, if the force is distributed more towards a top portion of first suspension portion 4 and less towards a bottom portion of first suspension portion 4, wings 12 located towards the top portion of suspension portion 4 can be bent more than wings 12 located towards the bottom portion of suspension portion 4. If, however, the force is distributed more towards the bottom portion of first suspension portion 4 and less towards the top portion of first suspension portion 4, wings 12 located towards the bottom portion of suspension portion 4 can be bent more than wings 12 located towards the top portion of suspension portion 4. Thus, even within suspension portion 4, sole 2 can better mold to the user's foot when force is placed on sole 2 by having wings 12, which bend in proportion to the force placed on it. Likewise, second suspension portion 6, third suspension portion 8, and/or fourth suspension portion 10 can perform like first suspension portion 4.

Figure 2:
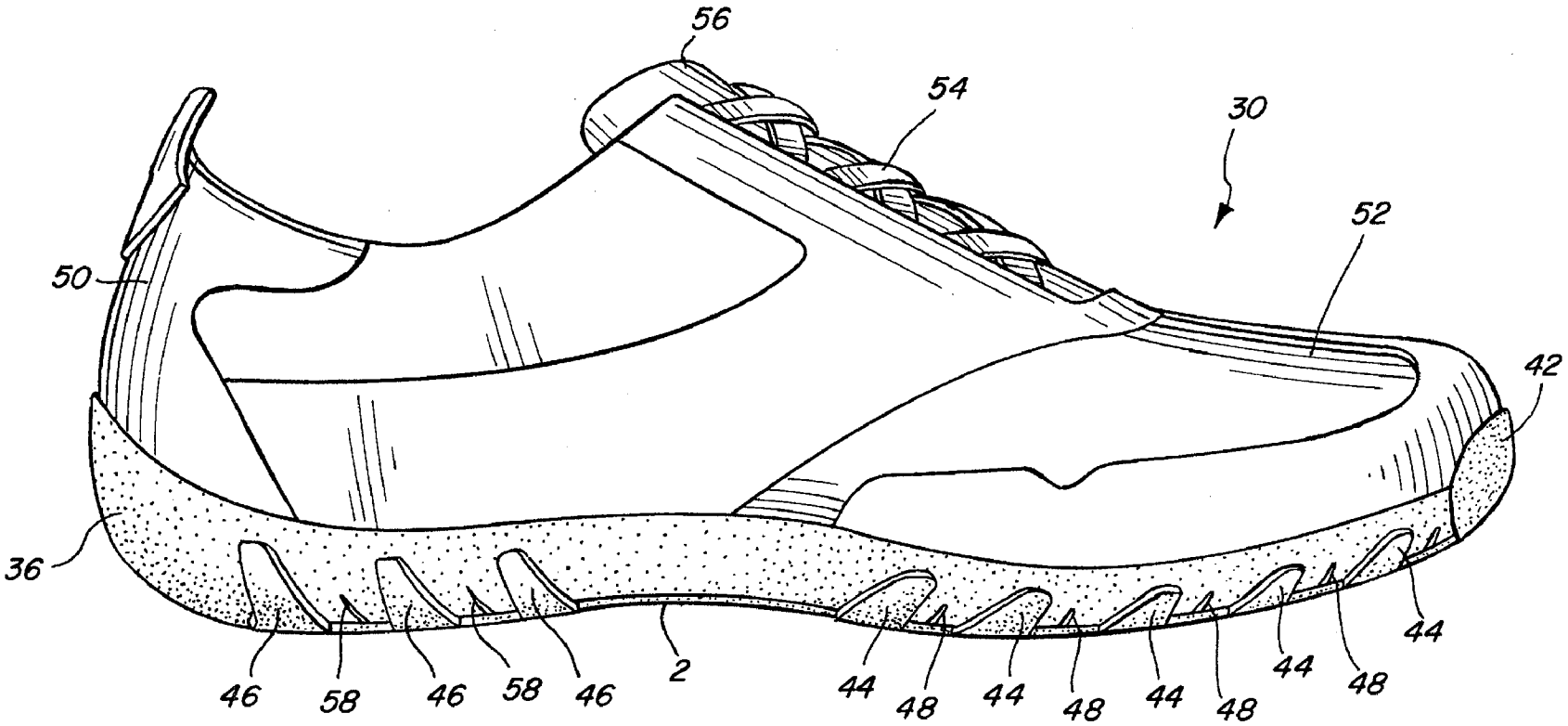
FIG. 2 is a side view of a shoe according to an embodiment of the present invention.

FIG. 2 depicts a first side of shoe 30. As shown in FIG. 2, shoe 30 can include an upper portion 50, a vamp 52, a lower portion 36, a tongue 56, shoe lace 54, and sole 2. Tongue 56 is connected to upper portion 50 and vamp 52. Shoe lace 54 is also connected to upper 50 and vamp 52 and rests on top of tongue 56. Shoe lace 54 can be pulled to tighten shoe 30 to provide a snug fit over the user's foot.

Shoe 30 can also have an optional toe pad 42 at the front of shoe 30 and connected to sole 2. Toe pad 42 can be used to provide additional grip traction for shoe 30 with the ground when the user is walking with shoe 30 because as the user is walking, a front portion of shoe 30 tends to touch the ground where toe pad 42 is located. Toe pad 42 can also be useful if the user wishes to climb various objects such as steep steps or even be used to wedge shoe 30 in crevices of a wall when climbing a wall. Toe pad 42 can also protect the user from stubbing his toe since a point of contact between shoe 30 and an object such as a leg of a table can be at the location of toe pad 42.

In one embodiment, shoe 30 optionally has a plurality of raised teeth 44 and 46, which are connected to first suspension portion 4 and third suspension portion 8, respectively (shown in FIG. 1). Plurality of raised teeth 44 and 46 protrude outward and can protect a first side of lower portion 36. Furthermore, plurality of raised teeth 44 and 46 can also provide traction for shoe 30 if a user wishes to move from side-to-side or wishes to wedge a side of shoe 30 along a crevice.

In another embodiment, shoe 30 can also optionally have a plurality of grooves 58 and 48 adjacent to plurality of raised teeth 46 and 44, respectively. Plurality of grooves 58 and 48 can reduce the weight of shoe 30.

Figure 3:
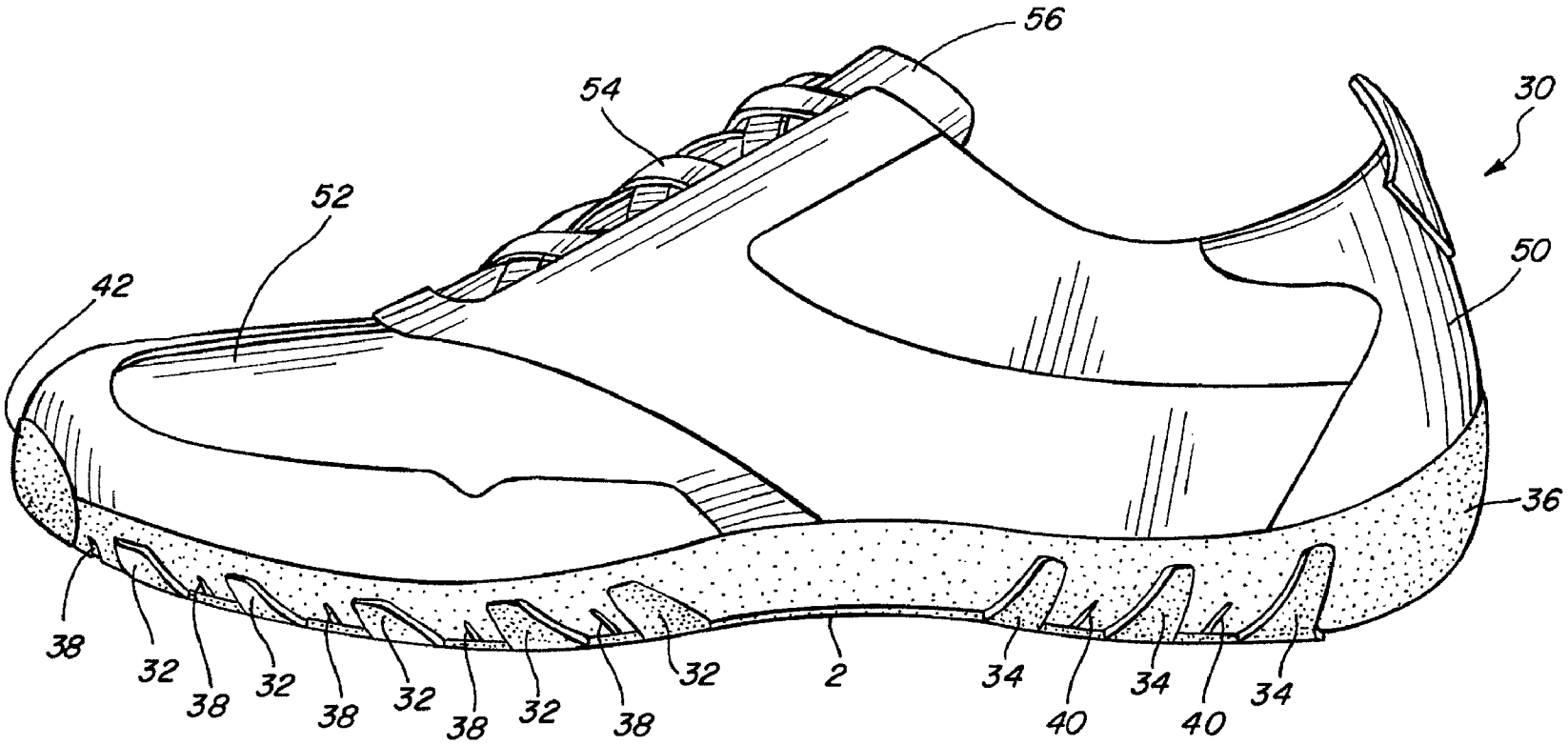
FIG. 3 is a side view of a shoe according to an embodiment of the present invention.

FIG. 3 depicts a second side of shoe 30. In one embodiment, shoe 30 optionally has a plurality of raised teeth 32 and 34, which are connected to second suspension portion 6 and fourth suspension portion 10, respectively (shown in FIG. 1). Plurality of raised teeth 32 and 34 protrude outward and can protect a second side of lower portion 36. Furthermore, plurality of raised teeth 32 can also provide traction for shoe 30 if a user wishes to move from side-to-side or wishes to wedge a side of shoe 30 along a crevice.

In another embodiment, shoe 30 can also optionally have a plurality of grooves 38 and 40 adjacent to plurality of raised teeth 32 and 34, respectively. Like plurality of grooves 58 and 48, plurality of grooves 38 and 40 can also reduce the weight of shoe 30.

Figure 4:
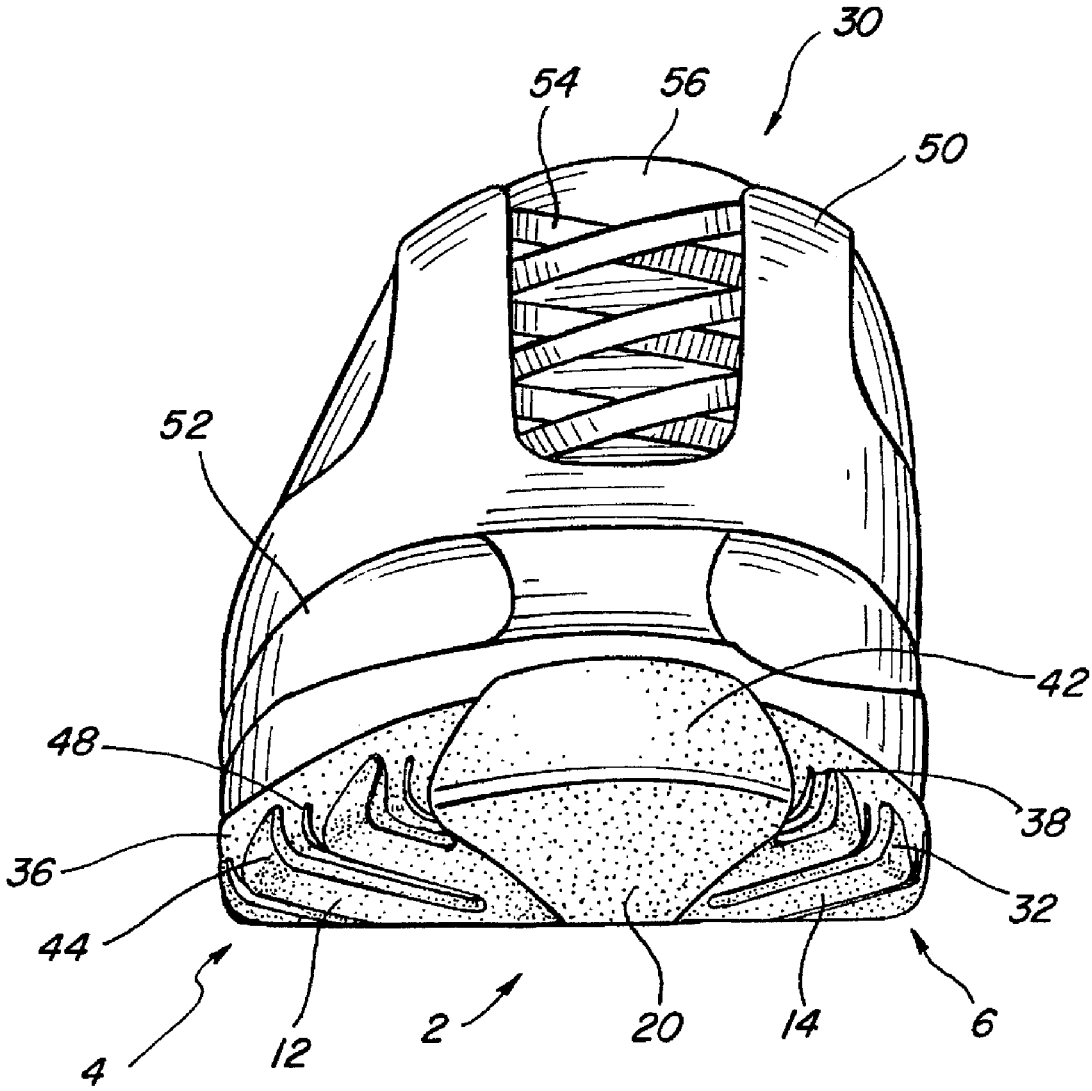
FIG. 4 is a front view of a shoe according to an embodiment of the present invention.

FIG. 4 depicts a front of shoe 30. As shown in FIG. 4, shoe 30 includes upper portion 50, vamp 52, lower portion 36, tongue 56, shoe lace 54, and sole 2. FIG. 4 also depicts sole 2 with first suspension portion 4, which includes plurality of wings 12, second suspension portion 6, which includes plurality of wings 14, and first spine 20. In one embodiment, first suspension portion 4 is connected to plurality of teeth 44 and second suspension portion 6 is connected to plurality of teeth 32. In another embodiment, toe pad 42 is connected to first spine 20. In yet another embodiment, shoe 30 includes plurality of grooves 38 and 48.

Figure 5:
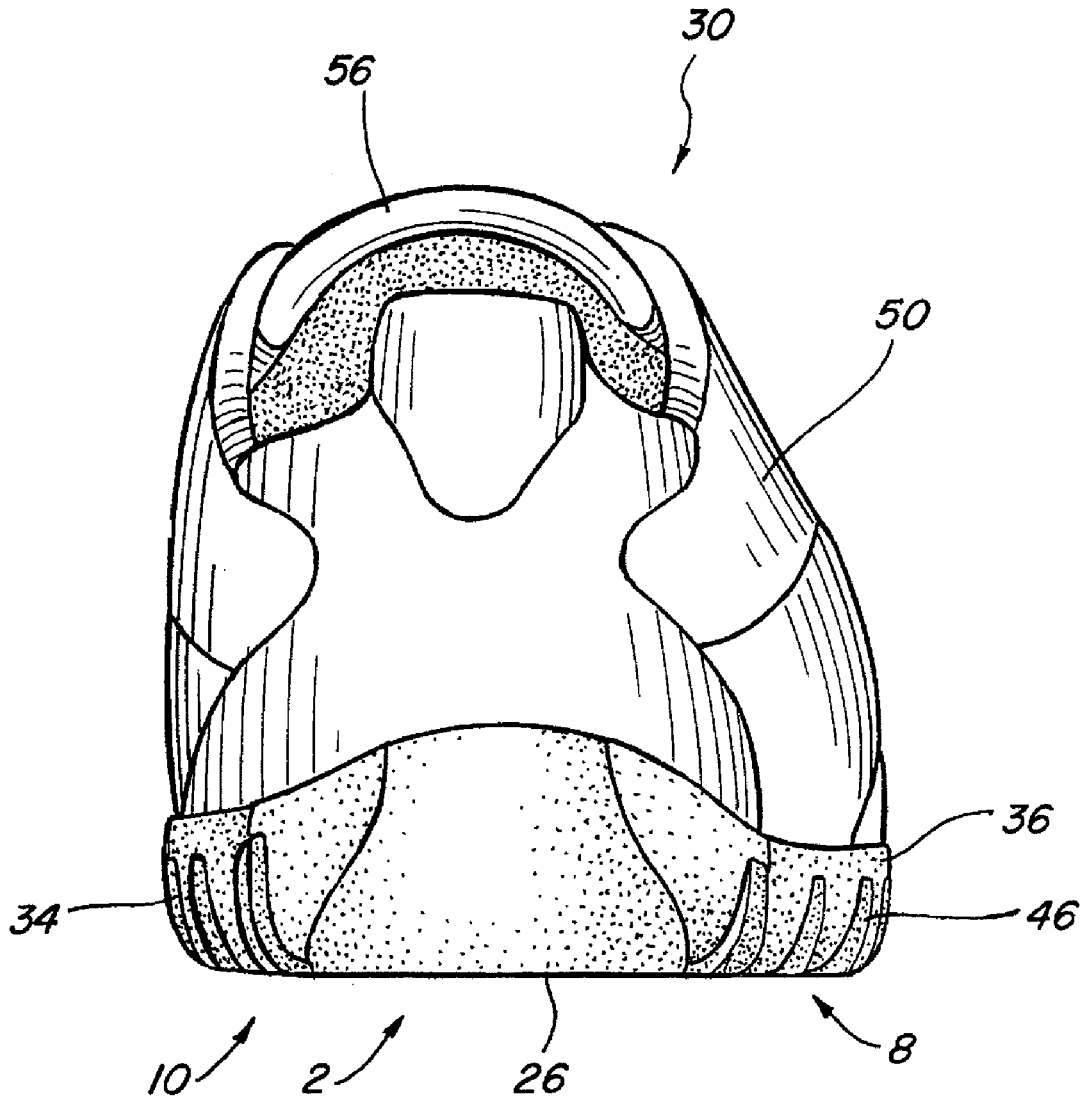
FIG. 5 is a rear view of a shoe according to an embodiment of the present invention.

FIG. 5 depicts a back of shoe 30. As shown in FIG. 5, shoe 30 includes upper portion 50, lower portion 36, tongue 56, and sole 2. FIG. 5 also depicts sole 2 with third suspension portion 8, fourth suspension portion 10, and second spine 26. In one embodiment, third suspension portion 8 is connected to plurality of teeth 46 while fourth suspension portion 10 is connected to plurality of teeth 34.

Shoe 30 can be a dress shoe, a walking shoe, a hiking boot, a snow boot, etc. Furthermore sole 2 can also be used not only on shoes, but also on sandals or any other type of device that can be used by the user to run, walk, or travel.

The previous description of the disclosed examples is provided to enable any person of ordinary skill in the art to make or use the disclosed shoe. Various modifications to these examples will be readily apparent to those skilled in the art, and the principles defined herein may be applied to other examples without departing from the spirit or scope of the disclosed shoe. The described embodiments are to be considered in all respects only as illustrative and not restrictive and the scope of the present invention is, therefore, indicated by the appended claims rather than by the foregoing description. All changes which come within the meaning and range of equivalency of the claims are to be embraced within their scope.

What is claimed is:

1. An outer sole of a shoe configured to contact a ground surface, the outer sole comprising:

a toe portion for supporting a forefoot area of a person's foot;

a mid portion attached to the toe portion, the mid portion for supporting an arch of the person's foot;

a heel portion attached to the mid portion, the heel portion for supporting a heel of the person's foot;

a first spine having a first end at the toe portion and a second end at the mid portion, the first spine having an hourglass shape and extending longitudinally from the toe portion to the mid portion, the first spine further including a first side and a second side;

a first suspension portion connected to the first side of the first spine, the first suspension portion located proximal to the toe portion;

a second suspension portion connected to the second side of the first spine, the second suspension portion located proximal to the toe portion and separated from the first suspension portion by the first spine;

a second spine having a first end at the mid portion and a second end at the heel portion, the second spine having an hourglass shape and extending longitudinally from the mid portion to the heel portion, the second spine further including a first side and a second side;

a third suspension portion connected to the first side of the second spine, the third suspension portion located proximal to the heel portion; and a fourth suspension portion connected to the second side of the second spine, the fourth suspension portion located proximal to the heel portion and separated from the third suspension portion by the second spine.

2. The outer sole of claim 1, further comprising a middle component configured to separate the second end of the first spine and the first end of the second spine, the middle component located proximal to the middle portion.

3. The outer sole of claim 2, further comprising a first bridge and a second bridge, the first bridge configured to separate the first suspension portion from the third suspension portion, and the second bridge configured to separate the second suspension portion from the fourth suspension portion.

4. The outer sole of claim 1, wherein the first suspension portion has a continuous surface with a first set of a wings, further wherein the first suspension portion defines a second set of wings, the members of the first set of wings alternating locationally with the members of the second set of wings, each of the first set of wings extending laterally from the first spine, each of the second set of wings extending laterally from a longitudinal portion of the first suspension portion.

5. The outer sole of claim 4, wherein the second suspension portion has a continuous surface with a third set of a wings, further wherein the second suspension portion defines a fourth set of wings, the members of the third set of wings alternating locationally with the members of the fourth set of wings, each of the third set of wings extending laterally from the first spine, each of the fourth set of wings extending laterally from a longitudinal portion of the second suspension portion.

6. The outer sole of claim 1, further comprising a set of teeth attached to the first suspension portion, the set of teeth extending in a direction orthogonal to a plane defining the outer sole, and away from the ground surface.

7. The outer sole of claim 6, further comprising a set of teeth attached to the second suspension portion, the set of teeth extending in a direction orthogonal to a plane defining the outer sole, and away from the ground surface.

8. An outer sole of a shoe configured to contact a ground surface, the outer sole comprising:

a toe portion for supporting a forefoot area of a person's foot;

a mid portion attached to the toe portion, the mid portion for supporting an arch of the person's foot;

a heel portion attached to the mid portion, the heel portion for supporting a heel of the person's foot;

a first spine having a first end at the toe portion and a second end at the mid portion, the first spine extending longitudinally from the toe portion to the mid portion, the first spine decreasing in width from the first end to a location proximal to a mid-point between the toe portion and the mid portion, and increasing in width from the location proximal to the mid point to the second end, the first spine further including a first side and a second side;

a first suspension portion connected to the first side of the first spine, the first suspension portion located proximal to the toe portion;

a second suspension portion connected to the second side of the first spine, the second suspension portion located proximal to the toe portion and separated from the first suspension portion by the first spine;

a second spine having a first end at the mid portion and the second end at the heel portion, the second spine extending longitudinally from the mid portion to the heel portion, the second spine decreasing in width from the first end to a location proximal to a mid-point between the mid portion and the heel portion, and increasing in width from the location proximal to the mid point to the second end, the second spine further including a first side and a second side;

a third suspension portion connected to the first side of the second spine, the third suspension portion located proximal to the heel portion; and a fourth suspension portion connected to the second side of the second spine, the fourth suspension portion located proximal to the heel portion and separated from the third suspension portion by the second spine.

9. The outer sole of claim 8, further comprising a middle component configured to separate the second end of the first spine and the first end of the second spine, the middle component located proximal to the middle portion.

10. The outer sole of claim 8, further comprising a first bridge and a second bridge, the first bridge configured to separate the first suspension portion from the third suspension portion, and the second bridge configured to separate the second suspension portion from the fourth suspension portion.

11. The outer sole of claim 8, wherein the first suspension portion has a continuous surface with a first set of a wings, further wherein the first suspension portion defines a second set of wings, the members of the first set of wings alternating locationally with the members of the second set of wings, each of the first set of wings extending laterally from the first spine, each of the second set of wings extending laterally from a longitudinal portion of the first suspension portion.

12. The outer sole of claim 11, wherein the second suspension portion has a continuous surface with a third set of a wings, further wherein the second suspension portion defines a fourth set of wings, the members of the third set of wings alternating locationally with the members of the fourth set of wings, each of the third set of wings extending laterally from the first spine, each of the fourth set of wings extending laterally from a longitudinal portion of the second suspension portion.

13. The outer sole of claim 11, further comprising a set of teeth attached to the first suspension portion, the set of teeth extending in a direction orthogonal to a plane defining the outer sole, and away from the ground surface.

14. The outer sole of claim 12, further comprising a set of teeth attached to the second suspension portion, the set of teeth extending in a direction orthogonal to a plane defining the outer sole, and away from the ground surface.

15. A bottom surface of a shoe configured to contact a ground surface, the bottom surface comprising:

a forefoot portion for supporting a forefoot area of a person's foot;

a mid portion connected to the forefoot portion, the mid portion for supporting a mid foot area of a person's foot;

a heel portion connected to the mid portion, the heel portion for supporting a heel of a person's foot;

a first spine having a first end at the forefoot portion and a second end at the mid portion, the first spine further having a first side extending longitudinally from the first end to the second end, and a corresponding second side extending longitudinally from the first end to the second end, the first spine having larger widths at the first end and second end and a smaller width at a location proximal to a mid-point between the forefoot portion and the mid portion;

a first suspension portion adjacent to the first side of the first spine, the first suspension portion located proximal to the forefoot portion;

a second suspension portion adjacent to the second side of the first spine, the second suspension portion located proximal to the forefoot portion and being separated from the first suspension portion by the first spine;

a second spine having a first end at the mid portion and a second end at the heel portion, the second spine further having a first side extending longitudinally from the first end of the second spine to the second end of the second spine, and a corresponding second side extending longitudinally from the first end of a second spine to the second end of the second spine, the second spine having larger widths at the first end of the second spine and second end of the second spine, and a smaller width at a location proximal to a mid-point between the mid portion and the heel portion;

a third suspension portion adjacent to the first side of the second spine, the third suspension portion located proximal to the heel portion; and a fourth suspension portion adjacent to the second side of the second spine, the fourth suspension portion located proximal to the heel portion and being separated from the third suspension portion by the second spine.

16. The bottom surface of claim 15, further comprising a middle component configured to separate the second end of the first spine and the first end of the second spine, the middle component located proximal to the mid portion.

17. The bottom surface of claim 15, further comprising a first bridge and a second bridge, the first bridge configured to separate the first suspension portion from the third suspension portion, and the second bridge configured to separate the second suspension portion from the fourth suspension portion.

18. The bottom surface of claim 15, wherein the first suspension portion has a continuous surface forming a first set of a wings and defining an second set of wings, the first set of wings interlocking the second set of wings, each of the first set of wings extending laterally from the first spine, and each of the second set of wings separated from the first spine and extending laterally from a longitudinal portion of the first suspension portion, and wherein the second suspension portion has a continuous surface forming a third set of a wings and defining a fourth set of wings, the third set of wings interlocking the fourth set of wings, each of the third set of wings extending laterally from the first spine, and each of the fourth set of wings separated from the first spine and extending laterally from a longitudinal portion of the second suspension portion.

19. The bottom surface of claim 15, wherein the third suspension portion has a continuous surface forming a fifth set of a wings and defining an sixth set of wings, the fifth set of wings interlocking the sixth set of wings, each of the fifth set of wings extending laterally from the second spine, and each of the sixth set of wings separated from the second spine and extending laterally from a longitudinal portion of the third suspension portion, and wherein the fourth suspension portion has a continuous surface forming a seventh set of a wings and defining a eighth set of wings, the seventh set of wings interlocking the eighth set of wings, each of the seventh set of wings extending laterally from the second spine, and each of the eighth set of wings separated from the second spine and extending laterally from a longitudinal portion of the fourth suspension portion.

* * * * *